US005860646A

United States Patent [19]

Fowler et al.

[11] Patent Number: 5,860,646

[45] Date of Patent: Jan. 19, 1999

[54] APPARATUS FOR ROTATING SUBSTANTIALLY FLAT ARTICLES

[75] Inventors: Maxie Joe Fowler; William Belmont Osteen, both of Hodge, La.

[73] Assignee: Stone Container Corporation, Chicago, Ill.

[21] Appl. No.: 871,774

[22] Filed: Jun. 9, 1997

Related U.S. Application Data

[63] Continuation of Ser. No. 546,082, Oct. 20, 1995.

[51] Int. Cl.[6] ..... B65H 29/00

[52] U.S. Cl. ..... 271/185; 198/411; 198/412

[58] Field of Search ..... 271/184, 185, 271/272, 119, 120; 198/411, 412, 415

[56] References Cited

U.S. PATENT DOCUMENTS

| | | | |
|---|---|---|---|
| 3,997,065 | 12/1976 | Jaksch | 241/1 BD |
| 4,192,495 | 3/1980 | Heinzelmann et al. | 271/10 |
| 4,928,807 | 5/1990 | Auerbach | 198/379 |
| 5,109,975 | 5/1992 | Prettie | 198/411 |
| 5,154,405 | 10/1992 | Graveson et al. | 271/2 |
| 5,535,999 | 7/1996 | Ford | 271/185 |

OTHER PUBLICATIONS

Weber Tube Turning Unit Brochure, H.G. Weber & Company, Inc., Kiel, Wisconsin, at least as early as May, 1994.

Model "N" Label Applicator Machine Brochure, H.G. Weber & Company, Inc., Kiel, Wisconsin, at least as early as May, 1994.

*Primary Examiner*—H. Grant Skaggs
*Attorney, Agent, or Firm*—Dick and Harris

[57] ABSTRACT

An apparatus for rotating substantially flat articles being transported along a production line is provided. The apparatus is configured so as to rotate the articles, about an axis extending substantially perpendicular to the direction of transport of the articles, through a desired number of degrees of rotation, while permitting the articles to be transported along the production line in a substantially uninterrupted and unimpeded manner.

14 Claims, 3 Drawing Sheets

APPARATUS FOR ROTATING SUBSTANTIALLY FLAT ARTICLES

This application is a continuation of Ser. No. 08/546,082, filed 20 Oct. 1995 and presently pending.

BACKGROUND OF THE INVENTION

The present invention is directed to apparatus for the manufacture and/or processing of substantially flat articles, such as printed products, or other products fabricated from paper, paperboard, corrugated material or the like. In particular, the present invention is directed to apparatus for changing the orientation of such substantially flat articles, while the articles are being transported along a transport path, in a production line.

In the manufacture of certain flat or substantially flat articles, such as paper bags, initial forming of the individual articles, for example from a continuous web of bag material, results in a stream of semi-finished articles which are being transported along a production line, in a particular orientation relative to the direction of movement. For example, in the production of flat-bottomed bags (such as a typical shopping bag), the individual bags leave the initial forming stage as individual half-finished bags, proceeding bottom-first along the production line.

While this (bottom-first) orientation may be advantageous for the initial forming of the individual bags, in that the orientation allows the initial formation to be done at a very high rate of speed (e.g., up to 600 bags per minute) from a continuous web or webs of material, such an orientation has, in the past, not been advantageous for the completion of manufacture of such articles. For example, the attachment of handles to such bags is difficult to accomplish, so long as the bag is oriented with its top-to-bottom axis extending parallel to the direction of transport of the individual bags. In such systems, the material for the handles typically must undergo a sharp change in direction (from the location of forming the handle components), in order to be attached to the longitudinally oriented moving bags on the production line.

Attempts have been made to provide apparatus for rotating the individual bags so that the top-to-bottom axis of each bag is transverse to the direction of travel, and the tops of the bags are positioned to the side of the conveyor, roller table of other means of transport, so that the handle applying apparatus may have facilitated physical access to both faces of the bags.

Some typical prior art apparatus for achieving this reorientation of the bags, relative to the direction of transport, might involve the slowing down of the speed of transport of the individual bags, for example, to permit manipulation by arms or stop members. In addition, other measures, such as directing the bags from one conveyor, to another, perpendicularly-disposed conveyor, while not turning the bags themselves, might be employed. Still other prior art turning apparatus have comprised stop motion turntables, which collect the articles individually or in groups, completely stopping their progress down the production line, while the articles are being reoriented, and then pushed onto a continuing conveyor, etc.

In still another prior art apparatus, which has been used by the H. G. Weber Company, a set of paired conical rollers are arranged with their axes perpendicular to the direction of transport of the articles to be turned. The conical roller pair is positioned so that the individual articles must pass between the rollers. The shape of the conical rollers, and their speed of rotation, relative to the speed of the oncoming articles, were configured such that upon contacting the rollers, the articles passing between them would be rotated ninety degrees. However, the turning apparatus utilized by the H. G. Weber Company is only capable of a specific degree of rotation, for any given roller configuration and roller speed combination.

It would be desirable to provide an apparatus for rotating articles, which are being transported along a production line, which apparatus is capable of accomplishing the rotation without the need to significantly slow the speed of the articles being transported along the production line.

It would also be desirable to provide an apparatus for rotating articles, such as substantially flat articles, which may be inserted into an existing production line, which does not require substantial modification and/or rerouting of portions of the production line.

It would further be desirable to provide an apparatus for rotating articles, which are being transported along a production line, which may accommodate articles being transported through a wide range of transportation speeds.

Accordingly, it is an object of the present invention to provide such a desired apparatus as described hereinabove.

These and other objects of the invention will become apparent, in light of the present specification, including claims, and drawings.

SUMMARY OF THE INVENTION

The present invention is an apparatus for the controlled rotation of substantially flat articles, wherein each of the articles has a pair of opposed faces, about an axis extending substantially perpendicular to the plane of the opposed faces, while the substantially flat articles are being transported along a transport path extending substantially parallel to a longitudinal axis, the apparatus being operably configured to individually and controllably rotate the articles, as the articles are transported, in succession, to the apparatus.

The apparatus comprises first means for receiving, in succession, the articles, which articles are being transported from a position upstream and along the longitudinal axis from the apparatus. The first receiving means are disposed at a pre-turning position, and being operably configured to seize and stabilize the articles, and propel the articles, individually and in succession, from the pre-turning position to an article turning position.

Turning means are operably disposed at the article turning position, for simultaneously grasping and propelling the articles, in succession along the transport path to a post-turning position while rotating the articles, individually and in succession, about the axis of rotation extending substantially perpendicular to the plane of the two opposed flat sides of the successive articles.

Second means for receiving the articles are positioned at a post-turning position located downstream from the turning position. The second receiving means are operably configured to grasp and stabilize the turned articles, following release of the articles by the turning means, toward precluding further undesired rotation of the articles.

The second receiving means are further configured to propel the articles, individually and in succession, from the post-turning position along a direction downstream relative to the transport path and to an article turning position, on a substantially continuous basis.

In a preferred embodiment of the invention, the apparatus is operably configured such that the direction of transport of the articles, upon exiting the apparatus is parallel to, and substantially aligned with the direction of transport of the articles prior to arrival at the apparatus.

In a preferred embodiment of the invention, the articles are transported along the transport path in an orientation such that the two opposed faces of the respective articles are arranged substantially parallel to the transport path. The first receiving means further comprises first support means operably disposed for providing vertically-directed support for the articles as the articles are transported to the pre-turning position; and first gripping means, operably associated with the support means, for providing intermittently applied gripping and propulsive force to the articles, as the articles approach, in succession, the pre-turning position. The first gripping means are operably configured so as to apply the gripping and propulsive force to each successively received article, only from arrival of each article at the pre-turning position, until seizing of each such article by the turning means.

The turning means comprise first article propulsion means, operably disposed at the turning position, and operably configured so as to impart a first velocity to at least a first portion of each successive article being transported through the turning means. Second article propulsion means are operably disposed at the turning position, and operably configured so as to impart a second velocity to at least a second portion of each successive article being transported through the turning means. The first and second article propulsion means are configured so that the second velocity is greater than the first velocity. Both the first and second velocities are in a plane parallel to the two opposed flat sides of each successive article, so as to cause each successive article to rotate about an axis substantially perpendicular to the plane parallel to the two opposed flat sides of each successive article.

The second receiving means comprise second support means operably disposed for providing vertically-directed support for the articles as the articles are released by the turning means; and second gripping means, operably associated with the support means, for providing intermittently applied gripping and propulsive force to the articles, as the articles are released in succession, from the turning means. The second gripping means are operably configured so as to apply the gripping and propulsive force to each successively received article, only upon release of each article at the turning position, until seizing of each such article by transport means operably disposed downstream of the second receiving means.

The first support means preferably comprises at least one roller member operably disposed for rotation about an axis extending substantially transversely to the transport path. The at least one roller member is further positioned so as to make contact with and support a lower facing one of the two opposed faces of each successive article.

Preferably, the at least one roller member is operably configured to be freely rotatable, and is not powered. Alternatively, a positive rotating force may be imparted to the at least one roller member, such that the at least one roller member will, in turn exert a propulsive force upon each successive article, along the direction of flow of articles along the transport path.

The first gripping means preferably comprises at least one segmented wheel member, operably disposed for rotation about an axis extending substantially transversely to the transport path. The at least one segmented wheel member has a region of maximum radius, configured such that an outer circumferential surface of the region of maximum radius will make gripping contact with an upper facing one of the two opposed substantially flat surfaces of each successive article, during a portion of each complete rotation of the at least one segmented wheel member. The at least one segmented wheel member further has a positive rotational force imparted thereto, to enable the at least one segmented wheel member to impart gripping and propulsive force to each successive article.

The at least one segmented wheel member may be preferably operably configured such that the amount of arc over which the region of maximum radius extends may be varied.

The first article propulsion means preferably comprises a first propulsion wheel member, operably disposed for rotation about an axis extending substantially transversely to the transport path, so as to make driving contact with an upper one of the two opposed faces of each successive article; and a second propulsion wheel member, operably disposed for rotation about an axis extending substantially transversely to the transport path, so as to make driving contact with a lower one of the two opposed faces of each successive article.

The first and second propulsion wheel members are preferably operably arranged for coordinated rotation together in a common plane, with rotational force being applied to the first and second propulsion wheel members, for causing rotation of the first and second propulsion wheel members in opposite directions about their respective axes, at a first rotational speed.

The second article propulsion means preferably comprises a third propulsion wheel member, operably disposed for rotation about an axis extending substantially transversely to the transport path, and substantially concentrically to the axis of rotation of the first propulsion wheel member, so as to make driving contact with an upper one of the two opposed faces of each successive article; and a fourth propulsion wheel member, operably disposed for rotation about an axis extending substantially transversely to the transport path, and substantially concentrically to the axis of rotation of the second propulsion wheel member, so as to make driving contact with a lower one of the two opposed faces of each successive article.

The third and fourth propulsion wheel members are preferably operably arranged for coordinated rotation together in a common plane which is disposed in laterally separated spaced relationship to the common plane of rotation of the first and second propulsion wheel members, with rotational force being applied to the third and fourth propulsion wheel members, for causing rotation of the third and fourth propulsion wheel members in opposite directions about their respective axes, at a second rotational speed, which is greater than the first rotational speed of the first and second propulsion wheel members.

In a preferred embodiment of the invention, the lateral spacing between the respective common planes of rotation of the first and second, and third and fourth wheel propulsion members, is selectively variable.

The second support means preferably comprises at least one roller member operably disposed for rotation about an axis extending substantially transversely to the transport path, the at least one roller member further being positioned so as to make contact with and support a lower facing one of the two opposed faces of each successive article. Preferably, the at least one roller member is operably configured to be freely rotatable, and is not powered. Alternatively, a positive rotating force may be imparted to the at least one roller member, such that the at least one roller member will, in turn, exert a propulsive force upon each successive article, along the direction of flow of articles along the transport path.

Still further preferably, the second gripping means comprises at least one segmented wheel member, operably disposed for rotation about an axis extending substantially transversely to the transport path, the at least one segmented wheel member having a region of maximum radius, configured such that an outer circumferential surface of the region of maximum radius will make gripping contact with an upper facing one of the two opposed substantially flat surfaces of each successive article, during a portion of each complete rotation of the at least one segmented wheel member, the at least one segmented wheel member having a positive rotational force imparted thereto, to enable the at least one segmented wheel member to impart gripping and propulsive force to each successive article. In a preferred embodiment, the at least one segmented wheel member is operably configured such that the amount of arc over which the region of maximum radius extends may be varied.

DETAILED DESCRIPTION OF THE DRAWINGS

Figure 1:
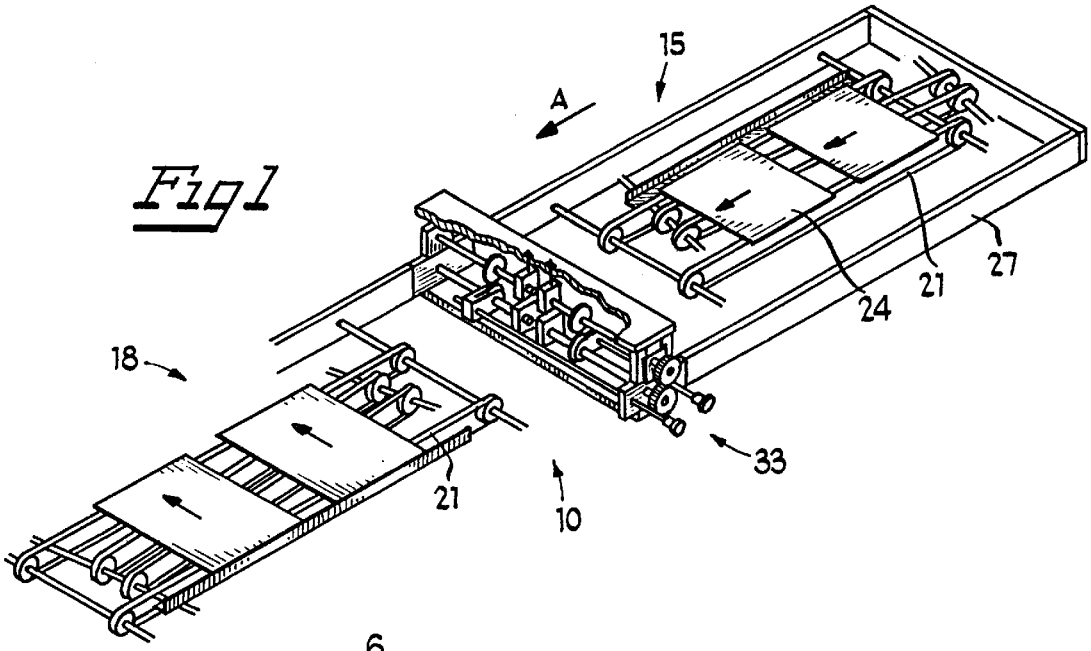
FIG. 1 is a fragmentary, partial perspective view of a production line, showing the turning section 33 of the apparatus for rotating articles, with the sections having the segmented wheels omitted for clarity.

While this invention is susceptible of embodiment in many different forms, there is shown in the drawings and will be described herein in detail, a specific embodiment, with the understanding that the present invention is to be considered as an exemplification of the principles of the invention and is not intended to limit the invention to the embodiment illustrated.

Figure 2:
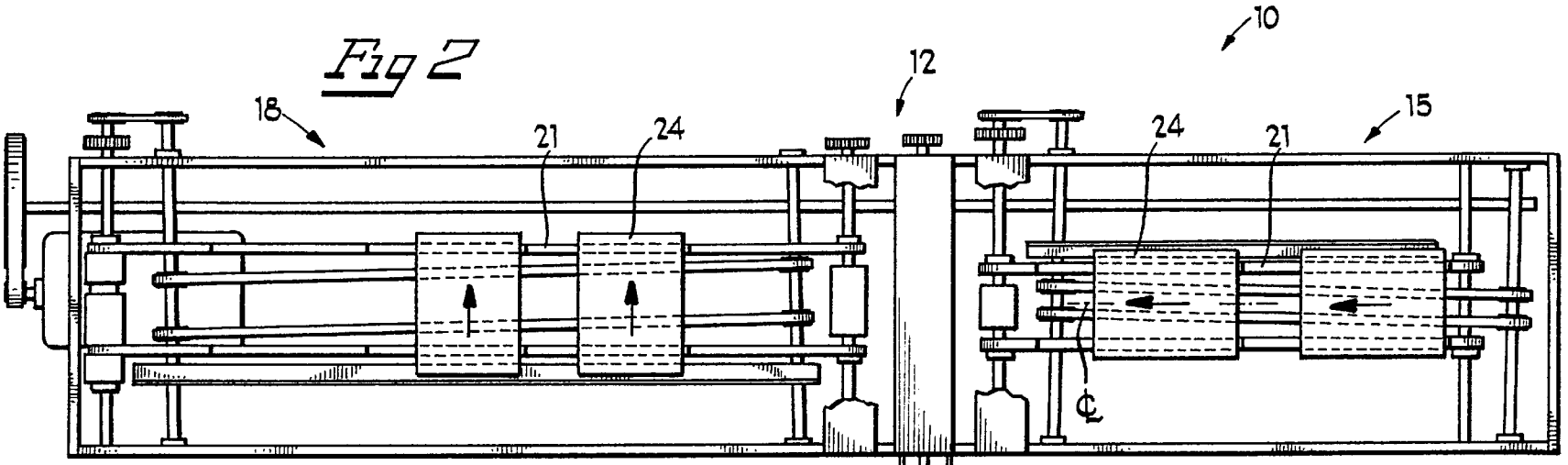
FIG. 2 is a top plan view of the production line of FIG. 1, showing the apparatus for rotating articles.
Figure 3:
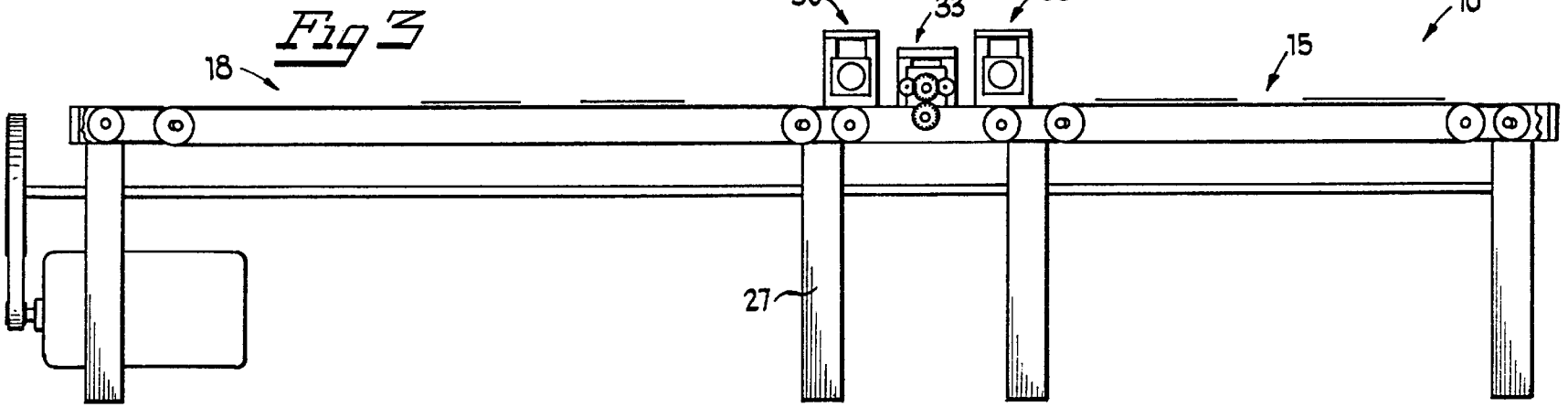
FIG. 3 is a side elevation of the production line of FIG. 2.

An apparatus 12, for rotating articles, such as may be installed into a production line 10 a portion of which is illustrated in FIGS. 1–3.

Production line 10 will include conveyor portions 15 and 18, leading to and from apparatus 12, respectively. Conveyor portions 15 and 18, in the preferred embodiment of the invention, are conveyortables in which continuous belts 21 are provided on which the articles 24 rest, and which carry the articles 24 along. Alternatively, conveyor portions 15 and 18 may comprise powered roller tables, or any other suitable device for transporting flat items in a positively propelled manner along a desired direction. Individual articles 24, in a preferred embodiment of the invention, are partially formed flat bottomed paper bags, such as may be fabricated, in a generally known manner, by a bag forming apparatus (not shown) positioned upstream from conveyor portion 15, although for the purposes of the present invention, articles 24 may be any substantially flat, relatively thin, article. The individual components making up production line 10 may be connected and/or commonly supported by a frame 27. The specific configuration and structure of frame 27 may be varied according to the specific requirements of each production line 10, according to generally known design principles, and so the configuration of frame 27 has been illustrated only generally.

Articles 24 each will be deposited on conveyor portion 15 in a particular orientation, relative to the direction of travel along conveyor portion, which direction is indicated by the arrow A. The orientation of articles 24 is indicated by the arrows illustrated on the individual articles 24. For example, the partially formed bags being ejected from a typical flat-bottomed bag forming machine, exit the former bottom-first, with the bag folded flat, the bottom resting against one of the sides (e.g., the "up" side) of the bag.

As previously mentioned, it may be desired to alter the orientation of the individual articles 24, while the articles 24 are being transported down the production line 10. For example, in the embodiment of a bag production line 10, in order to fasten handles onto the partially finished bags, attachment of the handles is facilitated if the bags can be re-oriented from their bottom-first orientation, to a sideways orientation, relative to their direction of transportation, as indicated by the arrows on the articles 24 which are on conveyor portion, downstream of apparatus 12. Once placed in the proper orientation, articles 24 are then transported to the next stage, of the production line 10, which in the preferred embodiment of the invention, may be a handle-applying apparatus, the specific details of which are not necessary for the understanding of the present invention, and have therefore been omitted for clarity of illustration.

Apparatus 12, for rotating substantially flat articles 24, in a preferred embodiment of the invention, includes three sections: an upstream gripper section 30, a turning section 33, and a downstream gripper section 36.

The rotation of the wheels of each of sections 30, 33 and 36 is, in a preferred embodiment of the invention, coordinated, for example by appropriate gearing or the like (not shown) interconnecting the respective shafts in the three sections, with rotational power being provided by a common source, like a common drive shaft or power belt, which may be configured according to known principles, so that if an increase in speed of the production line 10 is desired, the increase in speed may be accommodated simply by an increase in power to the common power source to the three sections 30, 33, 36.

Figure 8:
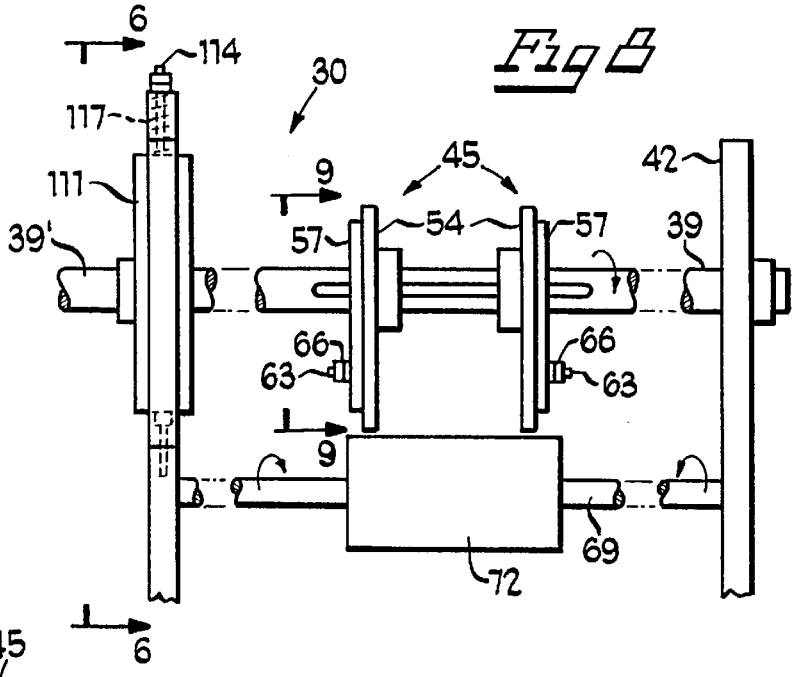
FIG. 8 is an partially schematic elevation of one of the segmented wheel sections.
Figure 9:
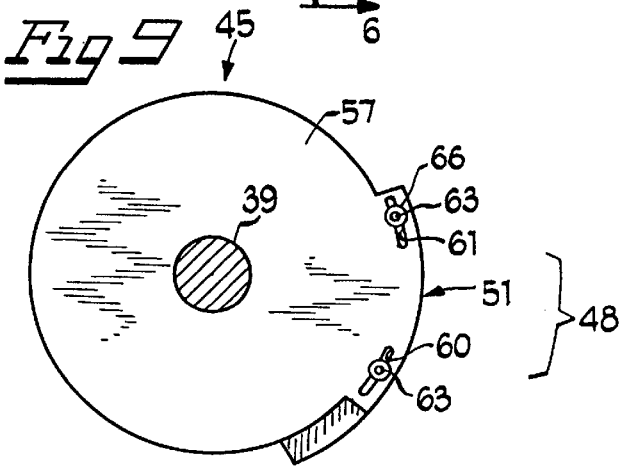
FIG. 9 is an elevation, taken along line 9—9 of FIG. 8.

Upstream gripper section 30 (FIGS. 2, 3 and 8) is positioned at the end of conveyor section 15, and comprises a single shaft 39 supported at its ends by upright frame portions 42, and mounted transversely to the flow of articles 24, for rotation relative to frame portions 42. Upstream gripper section 30 is illustrated in FIG. 8, as viewed from a position upstream of section 30. The rotation of segmented wheels 45 is appropriately coordinated such that the full-radius portion 48 of each segmented wheel 45, when in a "downward" position, makes contact with the upper surface of each article, just as each article 24 is carried by belts 21, to the end of conveyor section 15. Segmented wheels 45 are preferably fabricated from metal, such as iron, steel, etc. The outer surfaces 51 of the full radius portions 48 are provided with a sufficient coefficient of friction, relative to the material of articles 24, that when contact is made, segmented wheels 45 will be able to grab and propel articles 24 into turning section 33.

In a preferred embodiment of the invention, each segmented wheel 45 includes a fixed portion 54, which is keyed to shaft 39, and an adjustable portion 57, which has slots 60 therein, through which bolts 63, held by nuts 66, hold adjustable portion 57 to fixed portion 54. The two portions 54 and 57 cooperate (by being rotatable relative to one another from more or less overlapping positions) to enable the full radius portion 48 of each segmented wheel 45 to have a variable amount of arc, preferably yielding an arc length equal to the linear distance between the shaft 39 and shafts 87–87''', plus or minus a distance equal to 5° along the surface of the full radius portion 48. The remainder of the circumference of each segmented wheel 45 has a sufficiently reduced diameter, such that no contact with the article 24, which has just left conveyor section 15 is made, until the article 24 has effectively left the control of conveyor section 15, and no contact is made with the article 24 being handled, after it has been propelled into the turning section 33, come into contact with the wheels of turning section 33, and begun its rotation.

In a preferred embodiment of the invention, the speed of rotation of the segmented wheels 45 of upstream gripper section 30 will be set to propel the articles 24 through the section 30 at the same speed at which the articles 24 are carried along conveyor section, so as not to slow down the overall production line 10 speed, subject to the considerations discussed herein.

Shaft 39 may be powered in any suitable manner, such as by gearing or a pulley (not shown) mounted and keyed to one end of shaft 39, such as end 39'.

Situated parallel to shaft 39, which supports segmented wheels 45, but below the level of transport of articles 24, is shaft 69, which supports support roller 72. Roller 72, in a preferred embodiment of the invention, is not powered, but rather is supported on an independent set of bearings on shaft 69. Accordingly, roller 72 is permitted to freely rotate as the articles 24 pass through gripper section 30. In an alternative embodiment, roller 72 may be powered, for example, by a belt drive and/or interconnected by gears for counter-rotation with shaft 39.

Support roller 72 provides physical support for the articles 24 as they are fed into turning section 33. The propulsive force exerted on the articles 24 is greatest, when the full radius sections 48 of the segmented wheels 45 are in opposition to roller 72.

As illustrated in FIG. 8, the "upper" surface of support roller 72, and the surfaces of the full radius sections of segmented wheels 45, when in their downward positions, should approach each other closely, or may even make some contact, the resiliency of support roller accommodating any pressure exerted by wheels 45.

Figure 6:
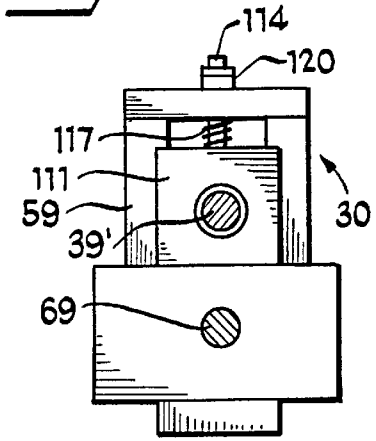
FIG. 6 is an end elevation of the gripper section 30 of the apparatus according to the present invention, taken along line 6—6 of FIG. 8.

Although in one preferred embodiment of the invention, shaft 39, once set in place, may be fixed against vertical movement, alternatively, as illustrated in FIG. 8 (left side only, for simplicity of illustration) and FIG. 6, a suitable mechanism for varying the tension or contact force between wheels 45 and roller 72 may be provided. Shaft 39 may be configured to be slightly raisable and lowerable, preferably at both ends (although only one end is illustrated in FIG. 8, it is understood that a substantially identical mechanism can be provided at the other end). As can be seen in FIG. 6, for example, shaft 39 may be supported by block 111, which is vertically movable relative to a frame 59. A bolt 114 passes downwardly through frame 59, and is biased by spring 117 to push downwardly on block 111. The maximum downward distance bolt 114 can reach may be adjusted by adjustment of nuts 120, in a known manner. The spring biasing permits slight separation movements, each time an article 24 passes through gripper section 30, with positive downward (and upward) force being exerted on each article, thus assuring positive traction and gripping force being applied.

Depending upon the specific application of the apparatus, the amount of vertical gap which will be provided will depend upon such variables as the thickness and compressibility of the articles being turned, the coefficient of friction of the surface of the articles and of the rollers, etc., and may be accommodated by variations in the diameters of the rollers and wheels, etc., according to known design techniques by one having ordinary skill in the art having the present disclosure before them.

Turning section 33, in a preferred embodiment, includes wheels 78,78', 78" and 78''', which are arranged in pairs, with one wheel of each pair arranged for rotation just above the plane of the articles being transported into turning section 33 by upstream gripper section 30, and one wheel of each pair arranged for rotation just below the plane of the articles. Each wheel 78, 78', 78" and 78''', includes a hub 81, 81', 81", 81''', respectively, and a "tire" 84, 84', 84", 84''', respectively. Each tire 84, 84', 84", 84''', is preferably fabricated from rubber, neoprene, or other similar material which has a relatively high coefficient of friction, relative to the material of the articles being turned, in order to assure that the tires maintain a good grip on the articles.

Each hub 81, 81', 81", 81''', respectively, is keyed to and supported for rotation with a respective shaft 87, 87', 87", 87'''. Shafts 87, 87' are rotatably supported at their outside ends by attached side support members 90, 90' and at their inside ends by inside support members 93, 93'. Similarly, shafts 87", 87''' are rotatably supported at their outside ends by side support members 90", 90''', and at their inside ends by inside support members 93", 93'''.

Figure 4:
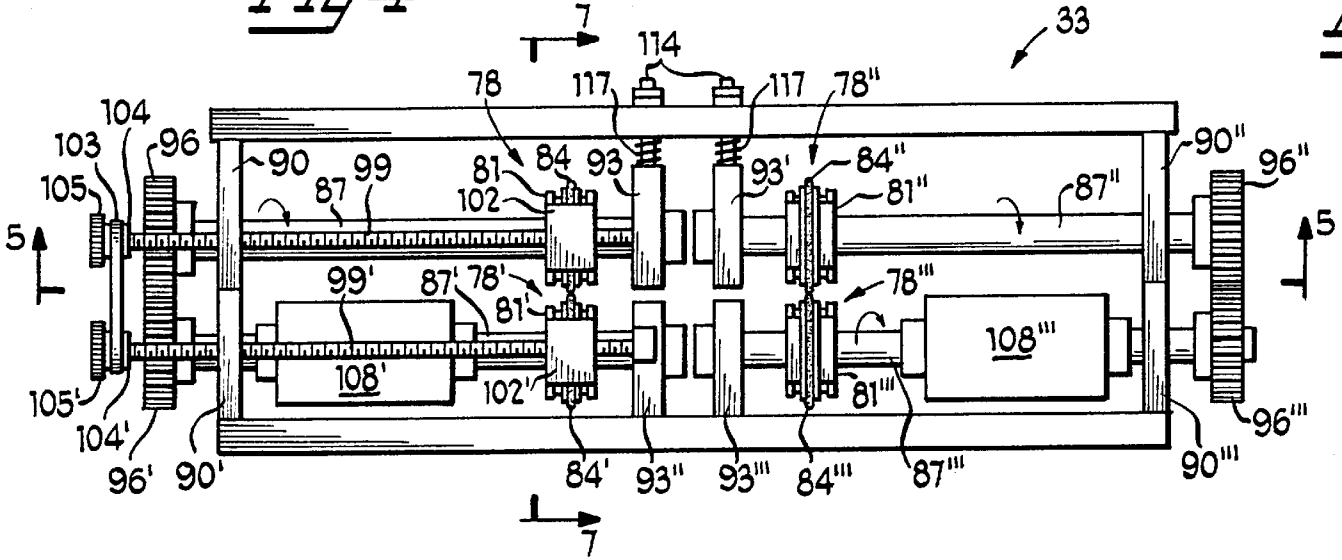
FIG. 4 is an elevation of the turning section 33 of the apparatus, according to the present invention, as seen from a position on the production line upstream from the turning section 33.

In the embodiment of the invention which is illustrated in FIG. 4, each article 24 is to be given a rotation which is clockwise, and so the apparatus 12 of the present invention will be described as being configured to accomplish rotation in that direction, although modification of the invention to accomplish rotation of articles 24 in the opposite direction may be readily accomplished by one of ordinary skill in the art, having the present disclosure before them.

To accomplish the desired rotation of articles 24, shafts 87, 87' corresponding to wheels 78, 78' (which comprise the paired set of wheels on the left as viewed in FIG. 1) are interconnected, by gears 96, 96', so that shafts 87 and 87' are rotating in opposite directions, in the directions of the arrows. Shafts 87", 87''', on which wheels 78", 78''' (which comprise the set, on the right as FIG. 1 is viewed) are likewise interconnected, by gears 96", 96''' so that shafts 87", 87''' are also rotating in opposite directions, in the directions of the arrows. However, to accomplish a rotation of articles 24 in the clockwise direction (as viewed in FIG. 1), shafts 87, 87', corresponding to wheels 78, 78', are driven at a significantly higher speed than shafts 87", 87''' of wheels 78", 78'''.

It would be desirable that the rotation of all the shafts be coordinated, so that the rotation of articles 24 will be consistent from one article 24 to the next. Upper shafts 87, 87" in a preferred embodiment of the invention, may not be independently, directly powered, but instead may be driven, as described, by gears, from the rotation of their respective lower shafts 87', 87'''. Lower shafts 87', 87''', in turn, will be connected to one another, not directly, but rather by suitable gearing (not shown) interposed therebetween, so that, for example, for every rotation of the right-hand pair (as seen in FIG. 4) of shafts 87'' and 87''', the left-hand pair of shafts 87 and 87' will undergo 4 rotations. In this way, only one of the four shafts needs to be directly powered, preferably at its outer end, for example by belt and pulley, gearing, or other suitable power delivery mode. The method of delivering rotational power to turning section 33 may be of otherwise conventional configuration, and accordingly the details of same have been omitted for clarity of illustration. It is understood that a pulley or further gear, through which power might be delivered, might be affixed to the outer ends of one of shafts 87', 87'''.

While, in a preferred embodiment of the invention, the gearing which is provided to establish the speed difference ratio between the two may be a fixed ratio, a variable gear change may be provided between the respective shaft pairs on the respective sides of turning section 33, in a manner which may be readily accomplished by one of ordinary skill in the art, having the present disclosure before them, so as to provide a substantially infinitely variable range of speed differentials between the respective shaft pairs. The speed differential between the respective pairs of shafts will depend, in part, upon the length-to-width proportions of the articles being rotated. For example, for articles which are very long and narrow, with the articles entering turning section 33 lengthwise, the speed differential should be high. For articles which are wide and/or which have nearly square proportions, the speed differential can be lower.

The mechanics of turning the articles 24, as the articles 24 pass through turning section 33 is as follows. The leading edge of an article 24 encounters wheels 78, 78' and 78'', 78''', simultaneously, passing between the upper and lower wheels of each set. Each article is propelled by upstream gripper section 30 into turning section 33. While both sets of wheels 78, 78' and 78'', 78''' are rotating so as to tend to pull article 24 through turning section 33, the wheels 78, 78' rotating at a much faster rate than that of wheels 78'', 78''', will tend to spin article 24 around a pivot point which will be actually be the continuously moving point of contact between the upper wheel 78'' and lower wheel 78''' and the respective upper and lower surfaces of article 24. It is believed that upon close observation, it will be observed that the path of the point of contact of the "pivot" wheels 78'', 78''' will describe an arc having a very short (or possibly even vanishingly small) radius of curvature, while the path of the point of contact of the wheels 78, 78' driving the rotation (the left set) will be an arc having a substantially larger radius of curvature.

The degree of rotation of article 24 which can be accomplished can be varied in several ways. First, the difference in the relative speeds of the wheels 78, 78' and wheels 78'', 78''' can be increased, which would produce a greater amount of rotation. A reduction in the difference in speeds would result in a lesser amount of rotation. In a preferred embodiment of the invention, wheels 78'', 78''' which make up the pivot point set will be driven at a speed which would tend to propel the article 24 through turning section 33 at a rate at which the flow of articles 24 is not impeded. The other set of wheels 78, 78' may be driven at a speed up to four times or even greater, than the speed of wheels 78'', 78''', in order to tend to push that side of article 24 through the turning section 33 at an even faster rate, creating a net torque on the article 24 around a vertical axis and thus causing the turning of the article.

As an alternative to, or in combination with, directly increasing the relative speeds of the left and right wheel sets, which might require that the two sets either be completely independently driven, or require the provision of a set of gear changes and a clutch to interconnect the two lower powered shafts, the equivalent effect can be accomplished by keeping the relative speeds of the wheel sets constant, but changing the distance between the wheels of the two sets. That is, the radius of curvature for the path of the point of contact for wheels 78, 78' (those driving the turning) will be changed. Since the radius is changed, for a constant rotational speed differential between the respective pairs of shafts, the amount of arc covered during passage of each article 24 through turning section 33 will be increased or decreased inversely to the change in radius, and so the amount of rotation of the article 24 will be increased or decreased inversely to the change in radius. For example, by shortening the distance between the sets, the amount of rotation will be increased, while lengthening the distance between the sets will decrease the amount of rotation of the article.

Figure 5:
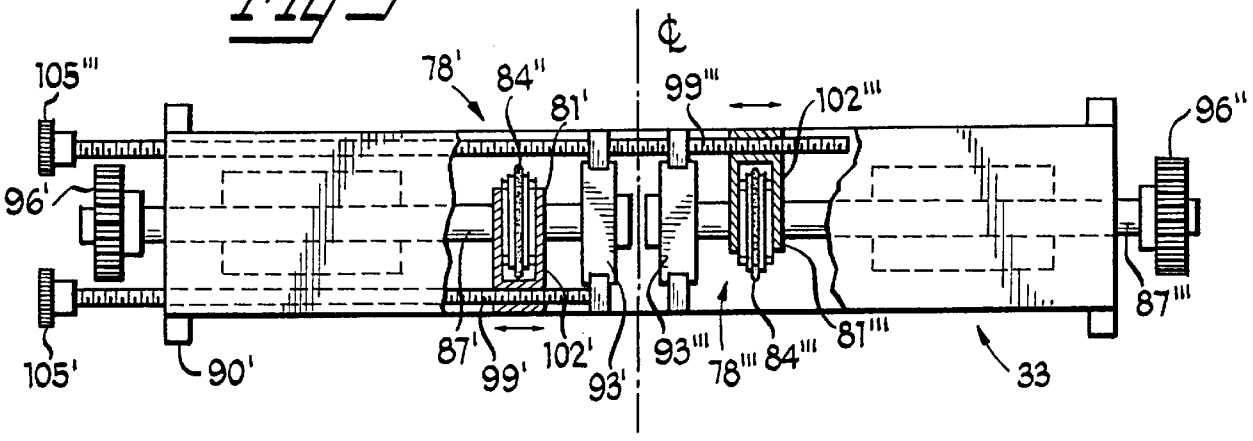
FIG. 5 is a top plan view, partly in section, of the turning apparatus according to FIG. 4.

In order to accomplish this variation in the distance between the wheel sets, as described, each wheel is keyed to its respective splined shaft for free movement along the shaft axis. To provide controlled movement of the wheels along the axes of their respective shafts, adjustment screws, such as screws 99, 99', 99''' (FIGS. 4, 5 and 8) are mounted for rotation in side support member 90' and inside support members 93, 93', and 93'''. Screws 99, 99', 99''', for axial movement of wheels 78, 78', 78''' are illustrated. The screw and bracket for wheel 78'' have been omitted from the drawings for simplicity of illustration. The upper and lower wheels of a pair (e.g., wheels 78, 78') are moved laterally simultaneously through a pair of screws (e.g., screw threaded through the support bracket of each. When the hand knob (e.g., knob 105') is turned to change the lateral position, the screw to which the knob is attached is threaded directly into one of the "turning" wheel brackets. The screw (e.g., screw 99') is connected to a second screw 99 controlling movement of the second wheel 78 of the pair through a pair of sprockets 104, 104' and connecting chain 103 which is positioned on the outside of the frame. The screws for wheels 78'', 78''' may be likewise connected.

Each screw 99, 99', 99''' will be threaded and engage corresponding threads in brackets 102, 102', 102''', which are provided to surround wheels 78, 78', 78'''. Knobs 105, 105', 105''' will be provided to enable rotation of screws 99, 99', 99''' to cause movement of wheels 78, 78', 78''' along the direction of the double-headed arrows in FIG. 5. As previously described, in an embodiment of the invention, screws 99', 99''' may be geared together for coordinated rotation in opposite directions, so that the two wheel sets, when adjusted, will move away from each other or toward each other, in equal amounts, so that the wheels will always be on opposite sides of an imaginary center line through turning section 33, at equal distances therefrom. Alternatively, all of the screws may be configured to operate completely independently.

An advantage of the screw arrangement so described, in either embodiment, is that adjustment of the wheel set positions can be accomplished without disassembly of turning section 33, and can even be done while the production line 10 is running, for making fine adjustments to the amount of rotation, for example, to compensate for variations in the amount of slippage which might occur between the tires 84, 84', 84'', 84''' and the surfaces of articles 24. Further, depending upon the circumferences of the wheels, relative to the size of the articles 24 being rotated, and the degree of variability of the separation between the wheel sets, virtually any amount of desired rotation can be accomplished, up to nearly 180 degrees of rotation.

Accordingly, in a preferred embodiment of the invention, the turning of the articles is accomplished through a combination of both the speed differential of the respective shaft pairs, as well as the variation in the spacing between the wheel pairs of the respective shaft pairs (primarily to permit fine-tuning), although, in alternative embodiments of the invention, turning may be accomplished solely through speed differential or variable spacing, depending upon the size and configuration of the articles being turned.

A further advantage of the configuration of the turning apparatus according to the present invention is that since the "pivot" wheels are preferably (or are capable of) spinning at a speed sufficient to keep up with the production line speed, the rotation of the articles 24 is accomplished with no appreciable slowing of the production speed.

If the articles 24 which are being rotated are thin and/or flexible, in addition to being flat, it would be desirable to provide support for the outer regions of the article, which are not supported by the wheels in the turning section 33, so that the outer edges, etc., do not dip and get caught in the mechanism of the apparatus during the turning procedure. To this end rollers 108', 108''' are provided, which surround shafts 87', 87''', respectively and are affixed to rotate together with shafts 87', 87'''. Rollers 108', 108''', have diameters which are slightly less than the overall diameters of wheels 78', 78''', so as not to exert any meaningful torque on articles 24, which might interfere with the turning process. Rollers 108', 108''' merely provide support for the outer portions of the articles 24, which will flex or droop slightly to rest lightly atop the upper surfaces of the rotating rollers 108', 108''' during the turning process.

In a preferred embodiment of the invention, the upper wheels 78, 78'' are suspended above lower wheels 78', 78''', such that the tires of each set of wheels just make contact with one another. Such a configuration is appropriate for particularly thin (in the vertical direction) articles, such as sheets of paper, thin paperboard or corrugated material, or thin bags or sacks. In an embodiment of the invention, the relative vertical spacing of the shafts for wheel pairs will be fixed, or wheel and tire dimensions will be selected, and determined in accordance with the characteristics of the articles to be turned. As just described, for thin articles, the shafts (or wheels and tires) will be selected and arranged so that the tires of the wheels may just touch and slightly compress one another. For thick articles, such as plywood or multiple thickness corrugated material, the shafts may be fixed (and/or different wheels and tires provided) so that the tires will have sufficient pressing contact with the article surfaces to provide the necessary traction without crushing, scoring or marking the articles as they pass. Small variances in the thicknesses of the passing articles will be accommodated in the resiliency of the tires.

In an embodiment of the invention, the shafts 87–87''' are fixed against vertical movement, while in operation, although adjustments to the vertical separation of the shafts of each respective pair can be adjusted between runs of the production line, by means of appropriately positioned and configured mounting bolts (not shown, but the details of which may be readily discerned by one of ordinary skill in the art having the present disclosure before them).

Figure 7:
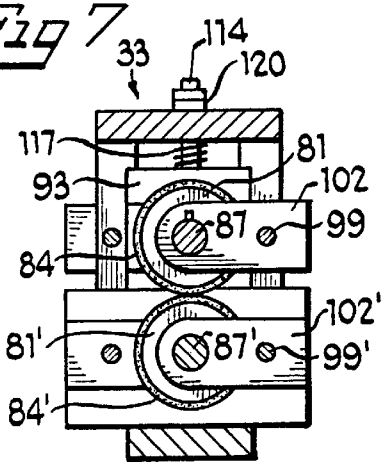
FIG. 7 is a sectional elevation of the turning section 33 of the apparatus according to the present invention, taken along line 7—7 of FIG. 4.

In an alternative embodiment of the invention shafts 87–87''' may be configured for adjustable and resiliently supported slight vertical movement, in the manner described with respect to the gripper section 30, of FIGS. 6 and 8, by providing shafts 87 (see FIG. 7) and 87'' springs 117, bolts 114 and nuts 120, and by configuring support members 93, 93' to be vertically movable, generally in the manner previously described.

In turning section 33, however, since the shafts 87–87''' have both inner and outer ends, the resilient support may be provided at the outer ends of the respective shafts, the inner ends of the respective shafts (as described arid illustrated), or both, if desired.

Although a turning section 33 has been described in which there are only two pairs of upper and lower turning wheels, the disclosed embodiment may be modified by one of ordinary skill having the present disclosure before them, by providing successive pairs of upper and lower wheel sets, in several successive stations longitudinally spaced along the turning section 33. Multiple disk pairs may be used in order to accomplish incremental turning of articles 24, or to "spread out" the turning operation over a longer distance (and thus longer period of time), or to accomplish discrete reorientation operations.

Once rotation of the articles 24 has been accomplished by turning section 33, it is necessary to stabilize each article 24 as it passes out of turning section 33, in part to eliminate the rotational momentum imparted to each article, so that each article 24 will be consistently left in a desired final orientation, once out of the turning section 33. Accordingly, downstream gripper section 36 is provided. Downstream gripper section 36 has a construction and operation which is generally similar to that of upstream gripper section 30.

Downstream gripper section 36 is positioned just downstream of turning section 33, and just upstream of the end of conveyor section, and comprises a single shaft mounted transversely to the flow of articles 24. Segmented wheels, substantially identical to wheels 57, as previously described relative to gripper section 30, are mounted on a powered shaft, similar to shaft 39. The rotation of the segmented wheels is appropriately coordinated such that the full-radius portions, when in their "downward" positions, make contact with the upper surface of each article 24, just as the trailing edge of each now-rotated article 24 leaves contact with the wheels of turning section 33. The segmented wheels are preferably fabricated from metal, such as iron, steel, etc. The outer surfaces of the full radius portions of the segmented wheels are provided with a sufficient coefficient of friction, relative to the material of articles 24, that when contact is made, the segmented wheels will be able to grab and propel articles 24 from turning section 33, onto the waiting belts of conveyor section 18.

It should be understood that the turning section 33 operates in such a way that the overall speed, in units per minute, of the production line can be maintained. For example, in the illustrated embodiment, the articles 24 entering the turning section 33 have a length to width ratio greater than 1 and have a particular spacing between the articles, which is, at least in part, a function of the operation of the apparatus placing the articles 24 onto section 15. As the articles are turned, the amount of conveyor length occupied by each article is less. Depending upon the speed of the slower of the two wheel pairs, and the speed of operation of gripper section 36 and the downstream section 18, the spacing between articles as they depart turning section 33 can be increased or decreased. Accordingly, with non-square articles, as illustrated, since the articles take up less conveyor belt length per unit, coming out of the turning section 33, even though conveyor section 18 may have a slower speed in terms of feet per minute (possibly, for elongated articles, even up to 20+% slower, in feet per minute), the production line rate, in terms of units per minute, can be substantially maintained.

When the articles are substantially square in plan, depending upon any change in spacing provided by turning section 33 and gripper section 36, the downstream unit per minute flow rate will depend more upon the speed of the conveyor section 18.

As stated with respect to the gripper section 30, in gripper section 36 each segmented wheel includes a fixed portion, and an adjustable portion. The two portions cooperate (by being rotatable relative to one another from more or less overlapping positions) to enable the full radius portion of each segmented wheel to have a variable amount of arc, preferably from a minimum of 90 degrees to 120 degrees. The remainder of the circumference of each segmented wheel has a sufficiently reduced diameter, that no contact with the article, which has just left turning section 33, is made, until the article 24 has effectively left the control of the wheels of turning section 33. No contact is made with the article 24 being handled, after the article 24 has been propelled onto the belts of conveyor section 18, and has made sufficient contact with the belts to begin to be transported away from downstream gripper section 36 in a stabilized manner. In a preferred embodiment of the invention, the speed of rotation of the segmented wheels of downstream gripper section 36 will be set to propel the articles 24 through the section at a substantially unimpeded rate, in accordance with the concepts described hereinabove, so as to send the articles onto section 36 in a smooth and controlled manner in coordination with the speed of conveyor section 18, which is, in part, dictated by the limitations and/or requirements of any equipment positioned downstream of conveyor section 18. Accordingly, gripper sections 30, 36 and turning section 33 cooperate to rotate the articles while moving them along the production line at a rate which, if so desired, and dependent upon the rate capacity of any downstream apparatus, will not otherwise impede the unit per minute rate of the production line.

Downstream gripper section 36 may be provided with a structure for adjustably, resiliently supporting the shaft supporting the segmented wheels, in a manner substantially identical to that described with respect to gripper section 30, previously.

Situated parallel to the shaft supporting the segmented wheels in gripper section 36, but below the level of transport of articles 24, is a shaft, which supports a support roller (as described with respect to upstream gripper section 30), which preferably is configured to be freely rotatable and not powered. Alternatively, the shaft supporting the roller may be powered such as by gearing or a belt drive, for example. The downstream gripper section 36 support roller provides physical support for the articles 24 as they are fed from turning section 33. The propulsive force exerted on the article 24 is greatest, when the full radius sections of the segmented wheels are in opposition to the support roller.

For rectangular (non-square) articles 24, the shift, or offset, of the center of the articles 24 away from an imaginary center line of the production line 10, upon exit from the turning section 33 depends upon the degree of centering of the articles 24 upon entry. For example, a centered, elongated article, will have one end farther to one side than the other, after turning. Such positioning may be advantageously employed in the described embodiment of a bag making production line 10, as described herein. As the partially made bags exit the bag forming portion (not shown), the bags are oriented bottom first, and have generally rectangular (non-square) configurations, as viewed from above, with their long dimensions extending parallel to the direction of travel of the production line 10. In addition, the articles 24 preferably will be generally centered from side-to-side, over the conveyor belts. Once the bags are turned, the "tops" of the bags are now to one side of the conveyor belts, and the conveyor may even be so positioned, that upon rotation of the bags, the tops will extend to the very side edge of the conveyor or even beyond, to facilitate access to the faces of the bags, to facilitate attachment of handles thereto.

The foregoing description and drawings merely explain and illustrate the invention, and the invention is not limited thereto except insofar as the appended claims are so limited, as those skilled in the art who have the disclosure before them will be able to make modifications and variations therein without departing from the scope of the invention.

What is claimed is:

1. An apparatus for the controlled rotation of substantially flat articles, wherein each of the articles has a pair of opposed faces, about an axis extending substantially perpendicular to the plane of the opposed faces, while the substantially flat articles are being transported along a transport path extending substantially parallel to a longitudinal axis, the apparatus being operably configured to individually and controllably rotate the articles, as the articles are transported, in succession, to the apparatus, the apparatus comprising:

first means for receiving, in succession, the articles, which articles are being transported from a position upstream and along the longitudinal axis from the apparatus, the first receiving means being disposed at a pre-turning position and being operably configured to seize and stabilize the articles, and propel the articles, individually and in succession, from the pre-turning position to an article turning position;

turning means, operably disposed at the article turning position, for simultaneously grasping and propelling the articles, in succession along the transport path to a post-turning position located downstream from the turning position, while rotating the articles, individually and in succession, about the axis of rotation extending substantially perpendicular to the plane of the two opposed flat sides of the successive articles;

second means for receiving the articles, positioned at the post-turning position located downstream from the turning position, the second receiving means being operably configured to grasp and stabilize the turned articles, following release of the articles by the turning means, toward precluding further undesired rotation of the articles, the second receiving means being further configured to propel the articles, individually and in succession, from the post-turning position along a direction downstream relative to the transport path and to an article turning position, on a substantially continuous basis, the apparatus further including means for adjustment of the turning means so as to vary the amount of rotation of each respective article, said adjustment means being further operably configured to permit such adjustment while the turning means is moving, the turning means including first and second pairs of rotating members, disposed for rotation about axes extending substantially perpendicular to the transport path, the first and second pairs of rotating members being disposed in laterally spaced relation to one another, the first pair of rotating members being further configured to be capable of being driven at a different rotational speed than the rotational speed of said second pair of rotating members;

the means for adjustment further including means for varying, while said turning means is moving, selectively one or both of the lateral separation between the first and second pairs of rotational members, and the respective rotational speeds of the first and second rotational members.

2. The apparatus according to claim 1, operably configured such that the direction of transport of the articles, upon exiting the apparatus is parallel to, and substantially aligned with the direction of transport of the articles prior to arrival at the apparatus.

3. The apparatus according to claim 1, wherein the articles are transported along the transport path in an orientation such that the two opposed faces of the respective articles are arranged substantially parallel to the transport path, and the first receiving means comprises:

first support means operably disposed for providing vertical-directed support for the articles as the articles are transported to the pre-turning position; and first gripping means, operably associated with the support means, for providing intermittently applied gripping and propulsive force to the articles, as the articles approach, in succession, the pre-turning position, the first gripping means being operably configured so as to apply the gripping and propulsive force to each successively received article, only from arrival of each article at the pre-turning position, until seizing of each such article by the turning means.

4. The apparatus according to claim 3, wherein the first support means comprises:

at least one roller member operably disposed for rotation about an axis extending substantially transversely to the transport path, the at least one roller member further being positioned so as to make contact with and support a lower facing one of the two opposed faces of each successive article.

5. The apparatus according to claim 4, wherein the first gripping means comprises:

at least one segmented wheel member, operably disposed for rotation about an axis extending substantially transversely to the transport path, the at least one segmented wheel member having a region of maximum radius, configured such that an outer circumferential surface of the region of maximum radius will make gripping contact with an upper facing one of the two opposed substantially flat surfaces of each successive article, during a portion of each complete rotation of the at least one segmented wheel member, the at least one segmented wheel member having a positive rotational force imparted thereto, to enable the at least one segmented wheel member to impart gripping and propulsive force to each successive article.

6. The apparatus according to claim 5, wherein the at least one segmented wheel member is operably configured such that the amount of arc over which the region of maximum radius extends may be varied.

7. The apparatus according to claim 1, wherein the articles are transported along the transport path in an orientation such that the two opposed faces of the respective articles are arranged substantially parallel to the transport path, and the turning means comprises:

first article propulsion means, operably disposed at the turning position, and operably configured so as to impart a first velocity to at least a first portion of each successive article being transported through the turning means; and second article propulsion means, operably disposed at the turning position, and operably configured so as to impart a second velocity to at least a second portion of each successive article being transported through the turning means, the second velocity being greater than the first velocity, and both the first and second velocities being in a plane parallel to the two opposed flat sides of each successive article, so as to cause each successive article to rotate about an axis substantially perpendicular to the plane parallel to the two opposed flat sides of each successive article.

8. The apparatus according to claim 7, wherein the first article propulsion means comprises:

a first propulsion wheel member, operably disposed for rotation about an axis extending substantially transversely to the transport path, so as to make driving contact with an upper one of the two opposed faces of each successive article; and a second propulsion wheel member, operably disposed for rotation about an axis extending substantially transversely to the transport path, so as to make driving contact with a lower one of the two opposed faces of each successive article, the first and second propulsion wheel members being operably arranged for coordinated rotation together in a common plane, rotational force being applied to the first and second propulsion wheel members, for causing rotation of the first and second propulsion wheel members in opposite directions about their respective axes, at a first rotational speed.

9. The apparatus according to claim 8, wherein the second article propulsion means comprises:

a third propulsion wheel member, operably disposed for rotation about an axis extending substantially transversely to the transport path, and substantially concentrically to the axis of rotation of the first propulsion wheel member, so as to make driving contact with an upper one of the two opposed faces of each successive article; and a fourth propulsion wheel member, operably disposed for rotation about an axis extending substantially transversely to the transport path, and substantially concentrically to the axis of rotation of the second propulsion wheel member, so as to make driving contact with a lower one of the two opposed faces of each successive article, the third and fourth propulsion wheel members being operably arranged for coordinated rotation together in a common plane which is disposed in laterally separated spaced relationship to the common plane of rotation of the first and second propulsion wheel members, rotational force being applied to the third and fourth propulsion wheel members, for causing rotation of the third and fourth propulsion wheel members in opposite directions about their respective axes, at a second rotational speed, which is greater than the first rotational speed of the first and second propulsion wheel members.

10. The apparatus according to claim 9, wherein the lateral spacing between the respective common planes of rotation of the first and second, and third and fourth wheel propulsion members, is selectively variable.

11. The apparatus according to claim 1, wherein the articles are transported along the transport path in an orientation such that the two opposed faces of the respective articles are arranged substantially parallel to the transport path, and the second receiving means comprises:

second support means operably disposed for providing vertically-directed support for the articles as the articles are released by the turning means; and second gripping means, operably associated with the support means, for providing intermittently applied gripping and propulsive force to the articles, as the articles are released in succession, from the turning means, the second gripping means being operably configured so as to apply the gripping and propulsive force to each successively received article, only upon release of each article at the turning position, until seizing of each such article by transport means operably disposed downstream of the second receiving means.

12. The apparatus according to claim 11, wherein the second support means comprises:

at least one roller member operably disposed for rotation about an axis extending substantially transversely to the transport path, the at least one roller member further being positioned so as to make contact with and support a lower facing one of the two opposed faces of each successive article.

13. The apparatus according to claim 12, wherein the second gripping means comprises:

at least one segmented wheel member, operably disposed for rotation about an axis extending substantially transversely to the transport path, the at least one segmented wheel member having a region of maximum radius, configured such that an outer circumferential surface of the region of maximum radius will make gripping contact with an upper facing one of the two opposed substantially flat surfaces of each successive article, during a portion of each complete rotation of the at least one segmented wheel member, the at least one segmented wheel member having a positive rotational force imparted thereto, to enable the at least one segmented wheel member to impart gripping and propulsive force to each successive article.

14. The apparatus according to claim 13, wherein the at least one segmented wheel member is operably configured such that the amount of arc over which the region of maximum radius extends may be varied.

* * * * *

UNITED STATES PATENT AND TRADEMARK OFFICE

CERTIFICATE OF CORRECTION

PATENT NO. : 5,860,646

DATED : January 19, 1999

INVENTOR(S) : Maxie J. Fowler
William B. Osteen

It is certified that error appears in the above-indentified patent and that said Letters Patent is hereby corrected as shown below:

Col. 5, line 62 Delete "conveyortable" and insert instead -- conveyor table --.

Col. 12, line 10 After "described" delete "arid" and insert instead -- and --.

Signed and Sealed this

Twenty-seventh Day of June, 2000

*Attest:*

Q. TODD DICKINSON

*Attesting Officer*

*Director of Patents and Trademarks*